US006473061B1

(12) United States Patent
Lim et al.

(10) Patent No.: US 6,473,061 B1
(45) Date of Patent: Oct. 29, 2002

(54) PLASMA DISPLAY PANEL DRIVE METHOD AND APPARATUS

(75) Inventors: Geun-Soo Lim, Kyunggi-do (KR); Woo Hyun Paik, Seoul (KR); Jeong Pil Choi, Kyunggi-do (KR); Eun Ho Yoo, Kyunggi-do (KR); Myung Ho Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/340,045

(22) Filed: Jun. 28, 1999

(30) Foreign Application Priority Data

Jun. 27, 1998 (KR) ..... P98-24612
May 10, 1999 (KR) ..... P99-16663
Jun. 2, 1999 (KR) ..... P99-20302

(51) Int. Cl.[7] ..... G09G 3/28

(52) U.S. Cl. ..... 345/60; 345/61; 345/62; 345/63; 345/68; 345/74.1; 345/55; 315/167; 315/168; 315/169.1; 315/169.4; 313/484; 313/491; 313/514; 313/517; 313/520

(58) Field of Search ..... 345/60, 61, 62, 345/55, 100, 63, 66, 68, 74.1, 76; 313/484, 491, 514, 517, 520; 315/167, 168, 169.1, 169.4

(56) References Cited

U.S. PATENT DOCUMENTS 5,126,632 A * 6/1992 Parker ..... 313/634
5,446,344 A 8/1995 Kanazawa ..... 315/169.4
5,828,353 A * 10/1998 Kishi et al. ..... 345/60
5,900,856 A * 5/1999 Iino et al. ..... 345/100
6,084,705 A * 7/2000 Zieba et al. ..... 359/350
6,133,903 A * 10/2000 Lee et al. ..... 345/76
6,271,810 B1 * 8/2001 Yoo et al. ..... 345/60

FOREIGN PATENT DOCUMENTS

JP 06-348227 12/1994
KR 98-4289 3/1998

* cited by examiner

*Primary Examiner*—Richard Hjerpe
*Assistant Examiner*—Ali Zamani
(74) *Attorney, Agent, or Firm*—Fleshner & Kim, LLP

(57) ABSTRACT

A PDP drive method capable of restraining the generation of contour noise and making to be high a brightness level. In the PDP drive method, discharging cells on the plasma display panel start simultaneously on a radio frequency discharge by row lines. Next, the radio frequency discharge, which is caused in each discharging cell on the row line, is erased by applying an erasing pulse corresponding to a brightness level of video to the discharging cells on a row line.

24 Claims, 14 Drawing Sheets

PLASMA DISPLAY PANEL DRIVE METHOD AND APPARATUS

BACKGROUND OF THE INVENTION

1. Field of the Invention

This invention relates to plasma display panel drive method and apparatus, and particularly to plasma display panel drive method and apparatus which is capable of preventing an generation of contour noise and making to be high a brightness level.

2. Related Art of the Invention

Recently, there have been actively developed the plasma display panel, hereinafter PDP, which facilitates to manufacture it and to implement a large screen. The PDP uses conventionally a gases discharging phenomenon and allows a picture to be displayed by visible rays emitted from a fluorescent material which becomes in a emitting light by vacuum ultraviolet rays generated at the gases discharge.

Referring to FIG. 1, there is shown a discharging cell 30 included in the PDP of an alternating current system having three electrodes. The discharging cell 30 includes an upper glass substrate 10 loaded with a sustaining electrode pair thereon and a lower glass substrate 20 loaded with an address electrode 22 thereon. The upper glass substrate 10, which is used as a face for displaying the picture, is arranged in parallel with the lower glass substrate 20 by a barrier rib (not shown), as shown in FIG. 1. The sustaining electrode pair consists of a scanning/sustaining electrode 14 and a sustaining electrode 16 formed side by side on the upper glass substrate 10. An upper dielectric layer 12 and a protective layer 18 are sequentially coated on the upper glass substrate 10 formed with the scanning/sustaining electrode 14 and the sustaining electrode 16 thereon. The address electrode 22 is formed on the lower glass substrate 20 to intersect with the sustaining electrode pair in perpendicular. On the lower glass substrate 20 having the address electrode 22, there are sequentially formed a lower dielectric layer 24 and a fluorescent material layer 26. Finally, a discharging gas is injected into a discharging space 28 provided by the barrier rib.

The discharging cell 30 having the structure as described above is selected by an address discharge caused between the address electrode 22 and the scanning/sustaining electrode 16. In the selected discharging cell 30, a sustaining discharge is caused between the scanning/sustaining electrode 14 and the sustaining electrode 16 to generate the vacuum ultraviolet rays. The vacuum ultraviolet rays allows the fluorescent material 26 to become in the emitting light, thereby generating the visible rays. Such a PDP of the alternating current system controls the number of the sustaining discharge to realize a stepwise brightness, i.e., a gray scale. The number of the sustaining discharge is recognized by users and manufacturers as an important factor determining the brightness of the PDP and a discharge efficiency. Actually, a rectangular pulse having the frequency of 10 KHz to 100 KHz is applied to the PDP of the AC system in order to perform the sustaining discharge. In this case, the sustaining discharge is generated once per sustaining pulse in a moment. Also, charged particles generated at the sustaining discharge move along with the polarity of the electrode on the discharging path formed between the sustaining electrode pair, thereby creating spatial electric charges into the discharging space of the cell 30. The sustaining discharge can not be maintained since the discharging voltage into the discharging space drops down to the voltage lower than a discharging start voltage due to the spatial electric charges. Consequently, in the PDP of AC system using the sustaining pulse, the discharging efficiency becomes low because the sustaining discharge is generated once in a moment per sustaining pulse.

To solve such a disadvantage in the PDP of the AC system, there is developed a PDP of radio frequency (RF) system. The PDP of RF system includes discharging cells as shown in FIG. 2. The discharging cell of FIG. 2 includes a RF electrode 42 formed on the below face of an upper substrate 40, a data electrode 52 disposed on a lower substrate 50, a scanning electrode 56 loaded on a dielectric layer to intersect with the data electrode 52 in perpendicular, a fluorescent material layer 60 coated the inner wall of a barrier rib 58. The dielectric layer 54 is disposed on the lower substrate 50 having the data electrode 52 thereon. If a driving voltage responding to a data signal is applied cross the data electrode 52 and the scanning electrode 56, an address discharge is caused to generate charged particles into the discharging cell. The charged particles become in a vibratory movement (or a swing movement) due to a vibratory electric field caused by a RF signal that provides across the scanning electrode 56 and the RF electrode 42. Then, the discharging gases ionize and excite continuously by the vibrate movement of the charged particles to generate continuously a discharge during a discharging period. Consequently, the PDP of the RF system has a physical effect such as a positive column having a higher discharging efficiency in a glow discharge. The RF signal to applied to the PDP of the RF system is a rectangular pulse (or a sine wave signal) having the frequency of sever MHz to sever tens MHz. However, it the charged particles and the ions are directly impacted to the barrier rib 58, the charged particle and the ion is re-combined and a light energy is converted into a thermal energy. Due to this, the light efficiency of the PDP becomes low. To prevent the leakage of the light, the polarity of the RF signal changes alternatively along with the vibrate width of the charged particle and the ion. Therefore, in the PDP using the RF discharge, the discharging efficiency enhances largely.

FIG. 3 illustrates the entire electrode configuration of the PDP having the discharging cells as shown in FIG. 2. As shown in FIG. 3, the PDP of RF system includes first to mth address electrode lines X1 to Xm arranged to oppose to column lines, first to nth scanning electrode lines Y1 to Yn arranged to oppose to row lines, and a RF electrode lines arranged in parallel with the scanning electrode lines Yl to Yn. The one ends of the RF electrode lines are connected each other. There provides the discharging cell 70 in each intersection of the address electrode lines Xl to Xm, the scanning electrode lines Y1 to Yn and RF electrode lines. The scanning electrode lines Y1 to Yn each is opposed to the RF electrode lines. The scanning electrode lines Yl to Yn and the RF electrode lines enable the RF discharge to be generated.

Such a PDP of RF system is driven by a PDP driving technique of address and display separation (ADS) system. In the PDP driving technique of ADS system, a single frame is divided into a number of sub-fields. Each sub-field is separated again into a preliminary discharging interval, an address discharging interval and a sustain discharging interval. The preliminary discharging interval and the address discharging interval become always same but the sustain discharging interval is different according to a brightness level. For example, if the single frame is divided into 8 sub-fields SF1 to SF8, the sustain discharging interval involved in each of 8 sub-fields SF1 to SF8 has a weighted value increasing at a ratio of 1, 2, 4, 8, 16, 32, 64 and 128, and the gray scale is implemented by combining the sustain discharging intervals. Also, the sub-field periods corresponding to each bit of the video data are proceeded at a fixed sequence of SF1→SF2→SF3→SF4→SF5→SF6→SF7→SF8.

As described above, the PDP driven by the method of modulating discharge time becomes to display the picture depending on the total quantity of the lights emitted during each sub field period. Due to this, an integration characteristic of lights established by the PDP drive method is not identified with a visual characteristic accepted by the eyes of human. As a result, the contour noise is generated in the picture on the PDP. The contour noise appears in the shape of a black stripe or a white stripe on the PDP which displays continuously two frames (or two pictures) having gray scale levels different from each other. In other words, in the case that two gray scale levels such as 127 and 128, 63 and 64,31 and 32 and so on, which allow the emitting light patterns of two frames to be entirely different from each other, are continuously displayed, the contour noise is generated. If there are continuously displayed one frame of 127 gray level and another frame of 128 gray level, the frame of 127 gray level allows the PDP to emit lights during first sub-field SF1 to seventh sub-field SF7, while the frame of 128 gray level enables the PDP to emit lights during only eighth sub-field SF8. The difference of brightness between two frames (or two pictures) is small but a time lag between the emitting patterns of two frames is enlarged to elongate the moving distance of an eimitting light point. In this case, there is generated the black stripe on the PDP displaying continuously the two frames. Also, when there are continuously displayed one frame of 128 gray scale level and another frame of 127 gray scale level, the contour noise of the white stripe appears on the PDP displaying continuously the two frames due to the reason as described above. Such a contour noise is generated a lot more when an object of complexion moves. In other words, the contour noise appears a lot more in moving picture that the face or body of human moves. Further, when a color picture is displayed by the PDP driving technique of ADS system, it is lost a color balance by the contour noise, thereby distorting the picture displayed on the PDP. Furthermore, in the PDP driving technique of ADS system, the preliminary and address discharging intervals, which is not contributive to the picture display, are elongated relative to the sustain discharging interval contributive to the picture display. Due to this, the brightness of picture becomes low and a consumption power increases.

In FIG. 4, there is shown a conventional PDP drive apparatus of RF system including an analog/digital (A/D) converter 100 for converting an analog video signal into a video data of 8 bits and a multiplexer 110 for multiplexing the bits of video data. The conventional PDP drive apparatus of RF system further includes a frame memory 120 storing temporary the video data from the multiplexer 110 and a memory controller 130 for rearranging the video data from the frame memory 120. Also, the conventional PDP drive apparatus of RF system has a demultiplexer 140 for separating the video data from the memory controller 130 according to the bit to output the video data separated in each bit and a data driver 150 for applying a driving pulse opposite to the video data from the demultiplexer 140 to a PDP 160. The A-D converter 100 samples the analog video signal every constant period and encodes a sampled analog video signal into the video data having 8 bits. The multiplexer 110 selects the bits of video data from the A/D converter 100 and applies a selected video bit data to the frame memory 120. Then, the frame memory receives sequentially the video bit data from the multiplexer 120 and stores temporary the video bit data. To this end, the frame memory 120 has the recording capacity adapted to storage the video data for one frame. The memory controller 130 rearranges the video data from the frame memory 120 and applies toward the data driver 150. If a sub-field is divided and rearranged to minimize the contour noise, the memory controller 130 must have a complex circuit configuration. The demultiplexer 140 separates the video data from the memory controller 130 in each bit. The video data is output from the demultiplexer 140 in such a manner that there is continued pixel data bits corresponding to a sub-field. For example, if the PDP 160 is driven during the least significant sub-field having a least weighting value, a least significant bit of pixel data appears continuously in the video data to be applied to the data driver 150. The data driver 150 responds to the pixel data and drives address electrode lines on the PDP 160. Such a conventional PDP drive apparatus minimizing the contour noise makes to complex its circuit configuration.

SUMMARY OF THE INVENTION

Accordingly, it is an object of the present invention to provide a PDP drive method and apparatus which is capable of restraining the generation of contour noise and making to be high a brightness level.

Another object of the present invention provides a PDP drive apparatus capable of simplifying its circuit configuration.

In order to achieve these and other objects of the invention, a PDP drive method according to one aspect of the present invention includes steps of: allowing discharging cells on the plasma display panel to start simultaneously on a radio frequency discharge by row lines; and applying an erasing pulse corresponding to a brightness level of video to the discharging cells on a row line to erase the radio frequency discharge caused in each discharging cell on the row line.

Further, a PDP drive apparatus according to another aspect of the present invention includes steps of: scanning row lines on the plasma display panel by one every horizontal period; and providing with a data triggering signal to start in a time lag the radio frequency discharge in each discharging cell on a row line during the horizontal period.

Furthermore, a PDP drive apparatus according to another aspect of the present intention includes steps of: causing a preliminary discharge in entire picture element cells; allowing the picture element cells on any one of row lines to start simultaneously on a sustaining discharge; and erasing the sustaining discharge in each picture element on the row line in a time lag according to a gray scale.

Additionally, a PDP drive apparatus according to another aspect of the present invention includes steps of: causing a preliminary discharge in entire picture element cells; and writing selectively lag the picture element cells on any one of row lines in a time according to a gray scale to start a sustaining discharge.

A PDP drive apparatus according to another aspect of the present invention includes: converting means for converting an input video signal into a video data; storage means for storing temporally the video data for a row line, control means for rearranging the video data for a row line stored in the storage means in order of brightness level and for generating driving signals having a time lag according to the brightness level; and data driving means for applying data triggering signals corresponding to the driving signals to data electrodes on the plasma display panel.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Figure 1:
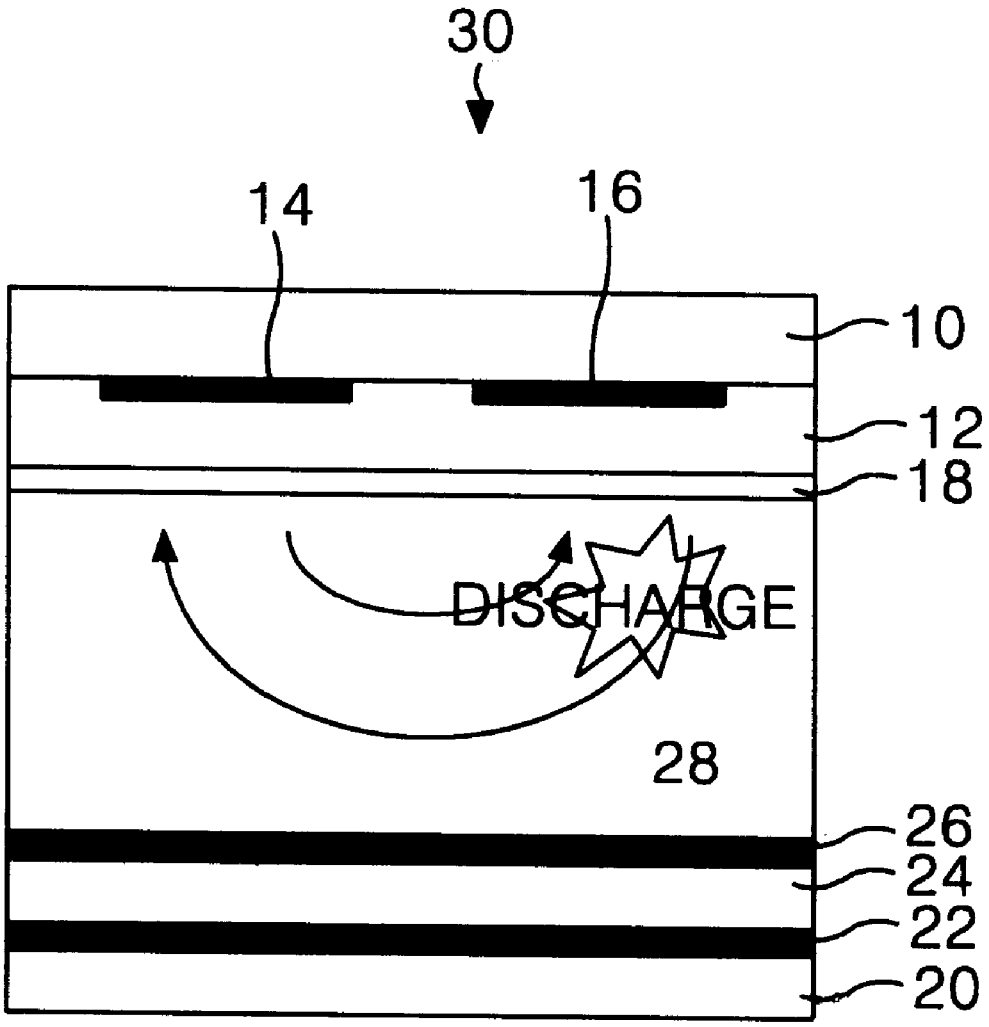
FIG. 1 CONVENTIONAL ART
FIG. 1 is a sectional view showing a discharging cell included in a conventional PDP of AC system having three electrodes.
Figure 2:
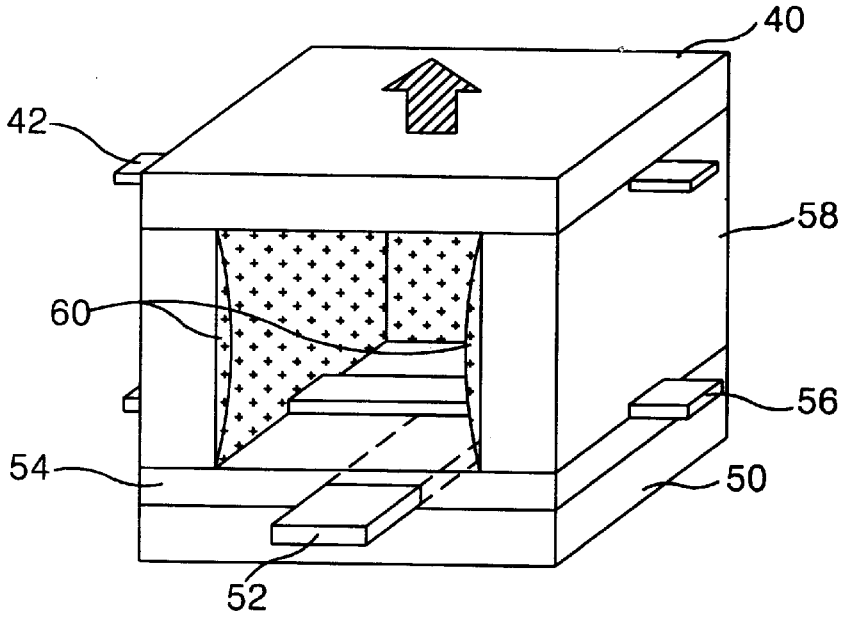
FIG.2 CONVENTIONAL ART
FIG. 2 is a perspective view showing a discharging cell included in a convention PDP of RF system.
Figure 3:
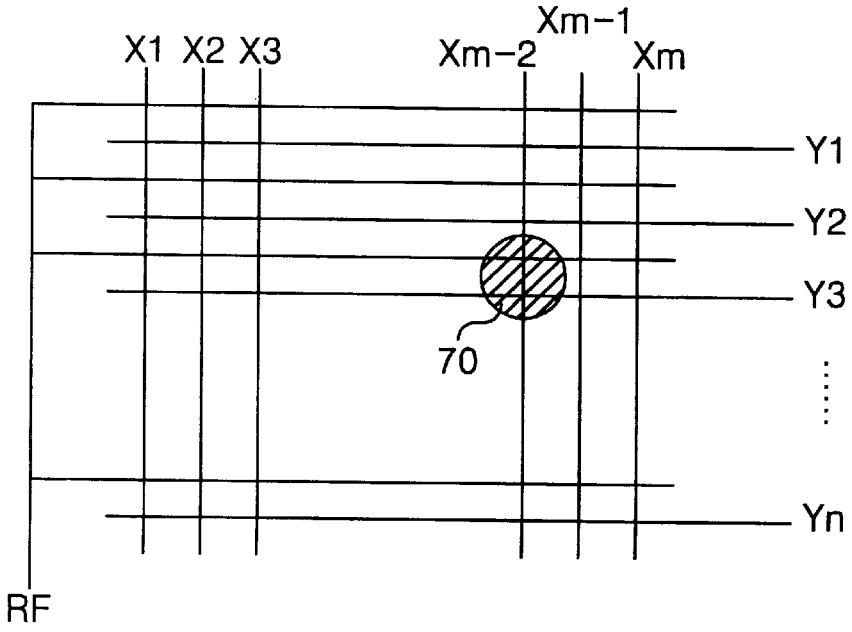
FIG.3 CONVENTIONAL ART
FIG. 3 shows a lay-out view showing the electrode configuration formed on a PDP having the discharging cell as shown in FIG. 2.
Figure 4:
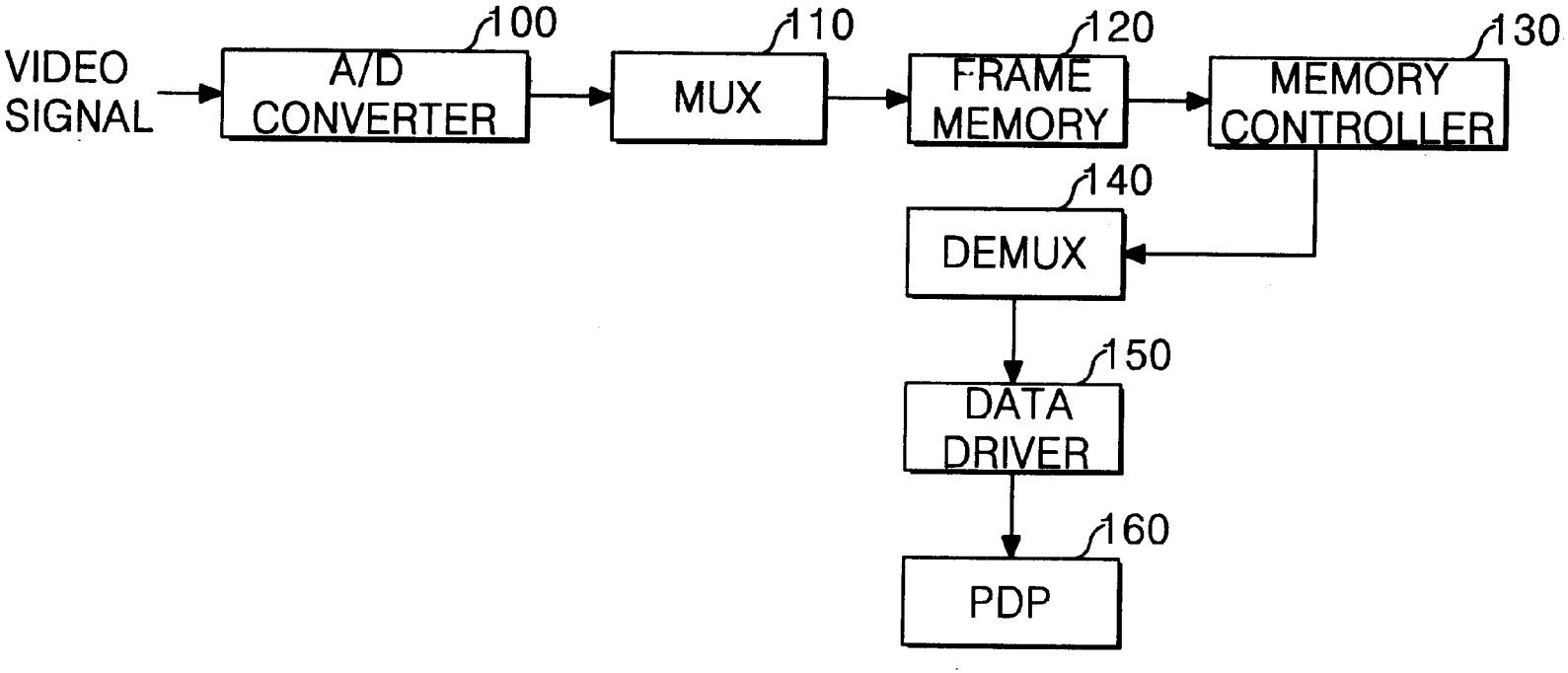
FIG. 4 CONVENTIONAL ART
FIG. 4 is a schematic block diagram showing a conventional PDP drive apparatus of RF system.
Figure 5:
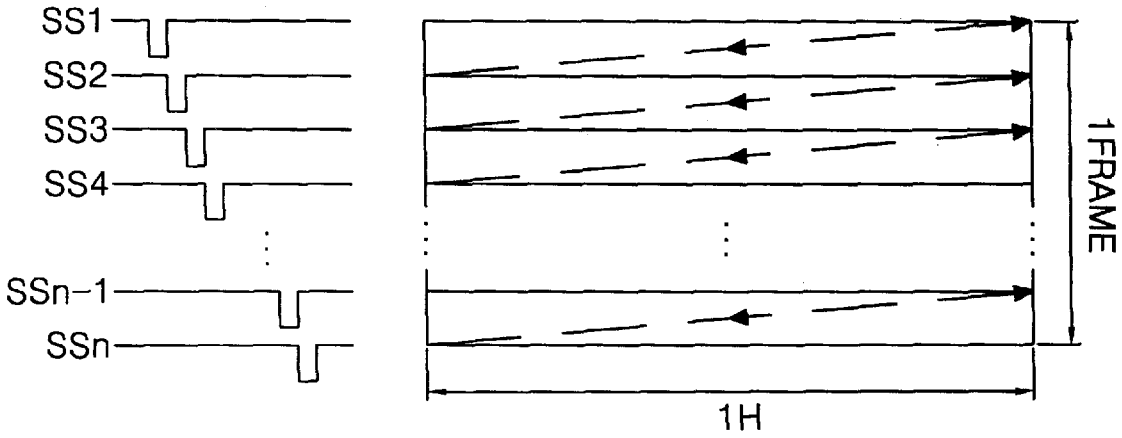
FIG. 5 is a schematic view explaining a PDP drive method according to an embodiment of the present invention.

Firstly, it will be described a PDP drive method according to an embodiment of the present invention in reference with FIG. 5 to FIG. 8. FIG. 5 explains conceptually a PDP drive method of RF system according to an embodiment of the present invention. The PDP drive method of RF system according to an embodiment of the present invention scans horizontal electrode lines on a PDP the same as a conventional cathode ray tube (CRT) drive method, thereby displaying a picture of gray scale. To this end, the PDP drive method allows first to nth sustaining signals SSl to SSn to be applied respectively to the n sustaining electrode lines Y1 to Yn as shown in FIG. 3 to select sequentially the n sustaining electrode lines Y1 to Yn. The first to nth sustaining signal SSl to SSn are sequentially enabled in a low logic state by a period of horizontal synchronous signal. In order to implement the gray scale, the PDP drive method varies differently a timing of data signal to be applied to discharging cell on each sustaining electrode depending on a brightness level the while each sustaining electrode line Yl to Yn is selected. In detail, the PDP drive method enables each discharging cell on the respective sustaining electrode line Y to start on a discharge at the start point of the horizontal synchronous period line before varies differently the timing of an erasing signal to be applied to each discharging cell, thereby realizing the gray scale. The PDP drive method according to an embodiment of present invention is sufficient to implement the gray scale because of having a discharging efficiency higher than that of the conventional PDP drive method of AC system using a signal of low frequency.

Figure 6:
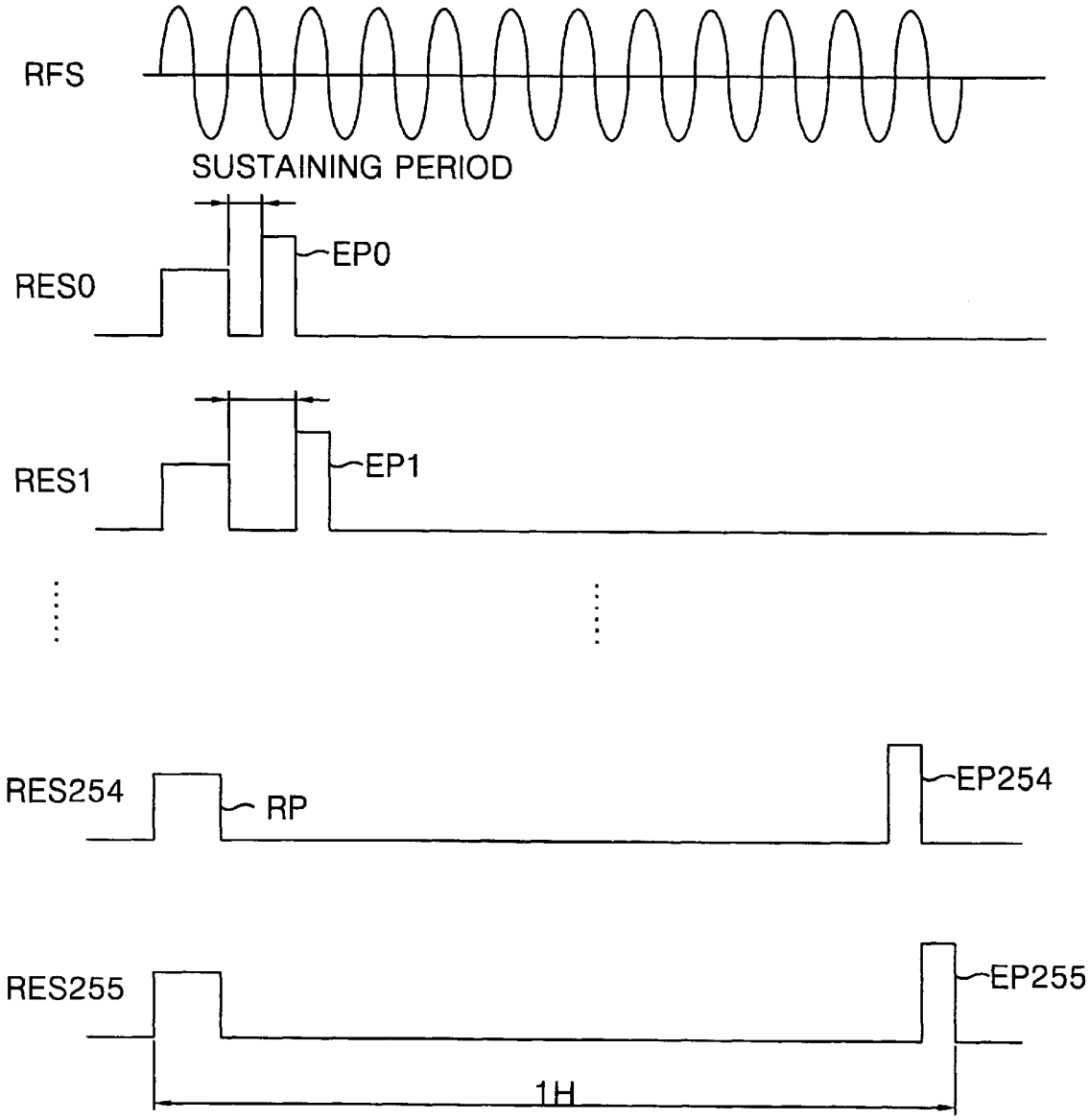
FIG. 6 is a waveform diagram showing driving signals which provide to implement 256 gray scales during single horizontal scanning period shown in FIG. 5.

FIG. 6 shows waveforms of driving signals for displaying 256 gray scale levels on any one of n row lines during one horizontal synchronous period. In order to display the 256 gray scale levels on a row line, all of discharging cells on the sustaining electrode line Y start on a RF discharge. The erasing pulse EP is then applied to each discharging cell on the sustaining electrode line Y at the time corresponding to the brightness level. In other words, a radio frequency signal RFS is commonly applied to RF electrode lines and a reset and erasing signals RES0 to RES255 are applied to address electrode lines X1 to Xm. In detail, the sustaining signal (not shown) is applied to an ith sustaining electrode line Yi and a reset pulse RP synchronous with the sustaining signal is supplied to each address electrode line X1 to Xm. Then, the discharging cell on the ith sustaining electrode line Yi start on the discharge. Also, the erasing pulse EP is selectively applied to address electrode lines Xl to Xm in order of brightness level. If all of 256 gray scale levels are displayed on a tow line during one horizontal synchronous period, there need 256 erasing pulses. The discharging cells, which displays the gray scale level of "0" corresponding to a least brightness level, receive an erasing pulse EP0 enabled at the start point of horizontal synchronous period. The erasing pulse EP0 erases the RF discharge from the discharging cells, thereby allowing the gray scale level of "0" to be displayed in the discharging cells. An erasing pulse EP1 is applied to the discharging cells for displaying the gray scale level of "1". The erasing pulse EP1 has a phase shifted from the erasing pulse EP0 by one step (i.e., an unit term). The erasing pulse EP1 allows the RF discharges in the discharging cells to be stopped so that the gray scale level of "1" is displayed in the discharging cells. As the erasing pulse EP is shifted more by the unit term along with the brightness level, the gray scale levels of 2 to 255 are displayed in the discharging cells, respectively. The gray scale level of 255 can be displayed without the erasing pulse EP255. Next, the 256 gray scale levels are selectively displayed in the discharging cells on the (i+1)th sustaining electrode line Yi+l, same as on the ith sustaining electrode line Yi. As described above, the sustaining signal is applied to the respective sustaining electrode line Y and the reset pulse RSP is supplied to the address electrode lines X1 to Xm, thereby allowing the discharging cells on the respective sustaining electrode line to start on the RF discharge. Then, the erasing pulses EP0 to EP255, corresponding to the number of brightness level to be displayed, are selectively applied to the address electrode lines Xl to Xm to control the RF discharging period of each discharging cell, thereby allows the gray scale levels to be displayed. In this case, the erasing pulse EP0 to EP255 are sequentially applied to the address electrode lines X1 to Xm along with the brightness level proceeding from a least level to a most level. Applied the discharging cells for displaying the gray scale level of "0" corresponding to a least brightness level are an erasing pulse EP0 enabled at the start point of horizontal synchronous period. The erasing pulse EP0 erases the RP discharge from the discharging cells, thereby allowing the gray scale level of "0" to be displayed in the discharging cells.

Figure 7:
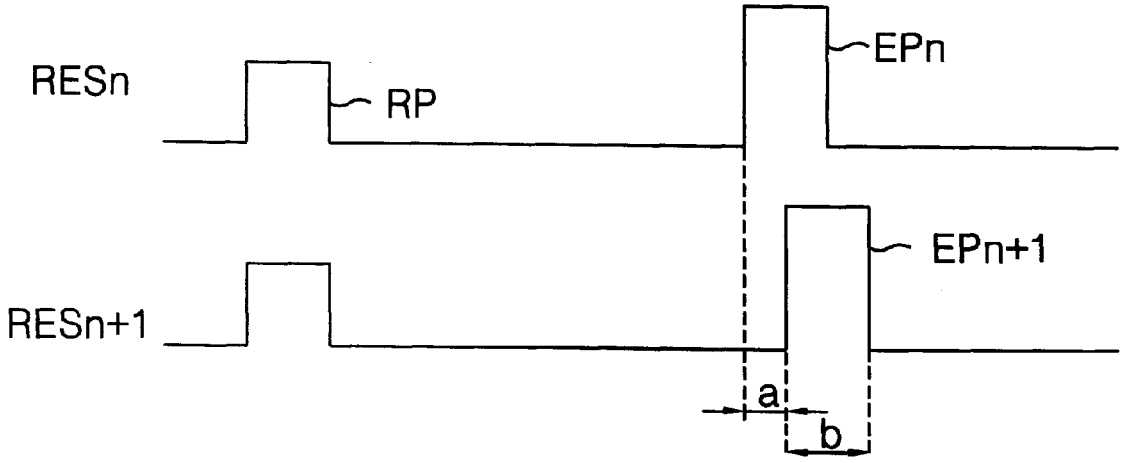
FIG. 7 is a waveform diagram showing in detail the erasing pulse in FIG. 6.

The width of Each erasing pulse EP0 to EP255 is determined as follows. If the picture is displayed in a definition of VGA class, the PDP has 480 row lines. In order to display the picture of 256 gray scale levels on the PDP during one frame period of 16.67 ms, a number of erasing pulses are 122, 880=256×480. Consequently, the width of the erasing pulse must become below about 130 ns=16.67 ms/122,880. However, the width of the erasing pulse can not be established below 130 ns due to a technical problem. Therefore, the erasing pulses EPn and EPn+1 adjacent to each other are preferably applied to the address electrode lines in such a manner to overlap partially, as shown in FIG. 7. In FIG. 7, the width of nth erasing pulse EPn is equal to that of (n+1)th erasing pulse EPn+1 and the nth erasing pulse. EPn is partially overlapped with.the (n+1)th erasing pulse EPn+1. In other words, a rising edge (i.e., a starting point) of the (n+1)th erasing pulse EPn+1 is delayed from that of nth erasing pulse EPn by the time difference capable of dividing the gray scale levels such that the gray scale levels can be displayed on the PDP. This results from that the gray scale is implemented in each row line. As a result, the time difference between the rising edges of nth and (n+1)th erasing pulses becomes below the 130 ns.

As described above, the PDP drive method according to an embodiment of present invention scans sequentially row lines on a PDP and displays the gray scale levels the respective row lines. Therefore, it is restrained the contour noise caused by the conventional PDP drive method. Also, the PDP drive method according to an embodiment of present invention allows the erasing pulses to be overlapped timely, thereby being free the erasing pulse in width.

Figure 8:
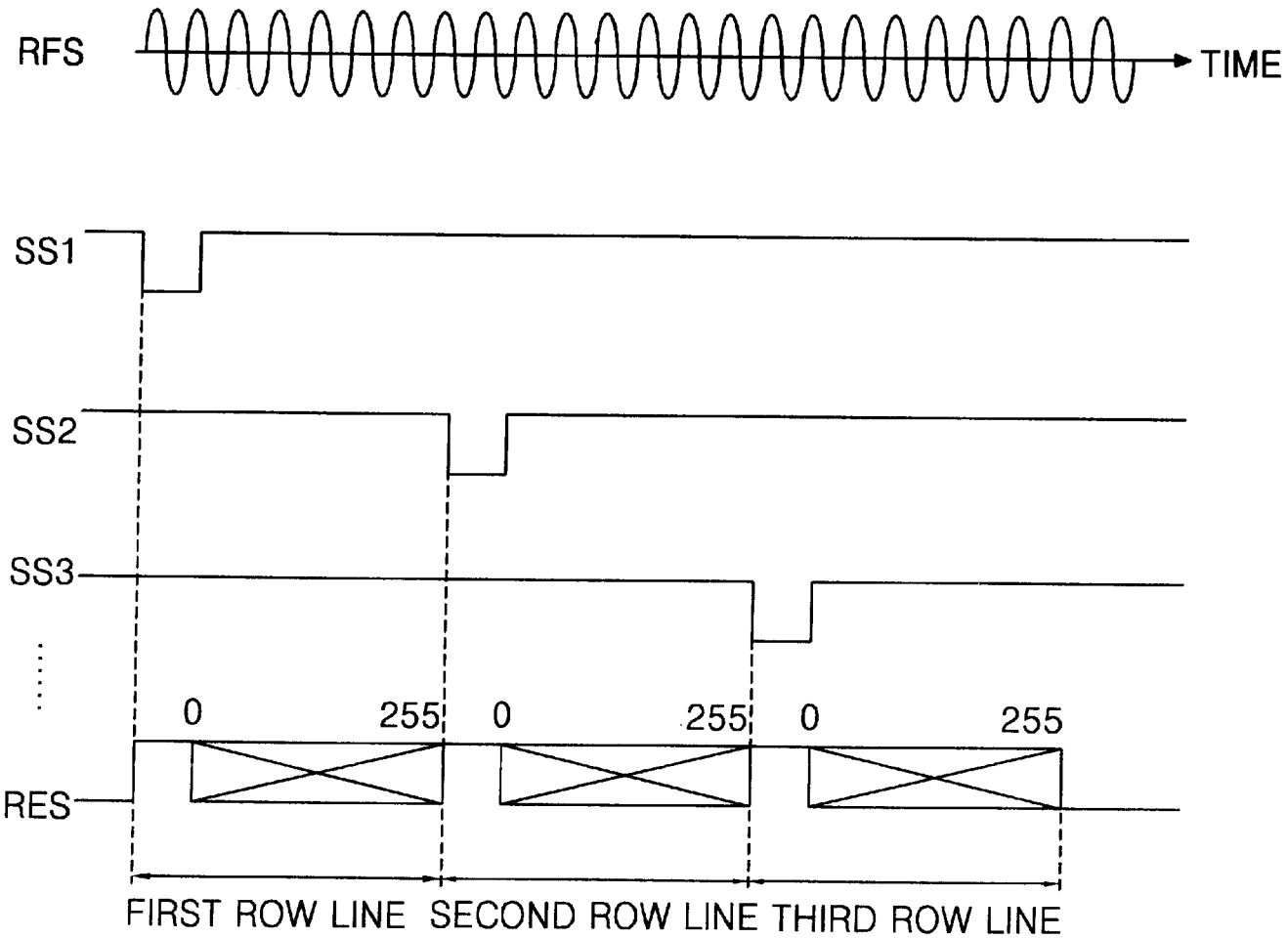
FIG. 8 is a waveform diagram of driving signals for explaining a PDP drive method according to an embodiment of present invention.

FIG. 8 explains entirely the PDP drive method of RF system according to an embodiment of the present invention. The PDP drive method of RF system has a step of scanning sequentially the row lines on the PDP such that the discharging cells of the respective row lines start simultaneously on a RF discharge. Also, the PDP drive method of RF system further includes a step of applying the erasing pulses selectively to the discharging cells of the respective row lines at the time corresponding to the brightness level of video signal to stop the RF discharge in the discharging cells receiving the erasing pulse. To this end, the PDP drive method provides a RF signal RFS, first to nth sustaining signals SS1 to SSn, and a reset and erasing signal. RES, as shown in FIG. 8. The RF signal RFS is applied to the RF electrode lines. The first to nth sustaining signals SSl to SSn are supplied to the sustaining electrode lines Y1 to Yn, respectively. The reset and erasing signal RES is applied to the first to mth address electrode lines X1 to Xm. If the first sustaining signal SS1 is applied to the first sustaining electrode line Y1 and a reset pulse RP is supplied to the m address electrode lines X1 to Xm in synchronization with the first sustaining signal SS1, the discharging cells on the first row line start simultaneously on the RF discharge. The erasing pulses are applied to the m address electrode lines X1 to Xm at the time corresponding to each brightness level of video signal during one horizontal synchronous period. Thus, each discharging cell on the first row line responds to any one of the erasing pulses to stop the RF discharge, thereby displaying any one of 256 gray scale levels. All of the discharging cells on the second row line start simultaneously on the RF discharge by the reset pulse RF in synchronization with the second sustaining signal SS2. Each discharging cell on the second row line allows the RF discharge to be stopped by any one of the 256 erasing pulses corresponding to the 256 brightness levels of video signal, thereby displaying anyone of the 256 gray scale levels. Similarly, the third to nth row lines each responds to the reset pulse synchronized to the respective sustaining signals SS3 to SSn such that the discharging cells on the respective is simultaneously discharged in the RF system. Each discharging cell on the respective row lines stops the RF discharge by any one of 256 erasing pulses corresponding to 256 brightness levels of video signal so that any one of 256 gray scale levels is displayed. Consequently, the PDP drive method of RF system according to an embodiment of the present invention enables the row lines to be scanned and the 256 gray scale levels to be displayed, thereby preventing the contour noise generated by the conventional PDP drive method. Also, the PDP drive method of RF system according to the present invention enables to discharge simultaneously the discharging cells on each row line by a reset pulse such that an addressing period is eliminated. To this end, the RF discharging period is elongated and a discharging efficiency increases. As a result, the PDP drive method of RF system according to an embodiment of the present invention provides with the enhanced brightness. Further, the PDP drive method of RF system according to art embodiment of the present invention allows the sustaining signal to have the width narrower than that of sustaining signal, which is provided by the conventional PDP drive method, corresponding to a period of horizontal synchronous signal. Therefore, the PDP drive method of RF system according to an embodiment of the present invention reduces a consumption power.

Figure 9:
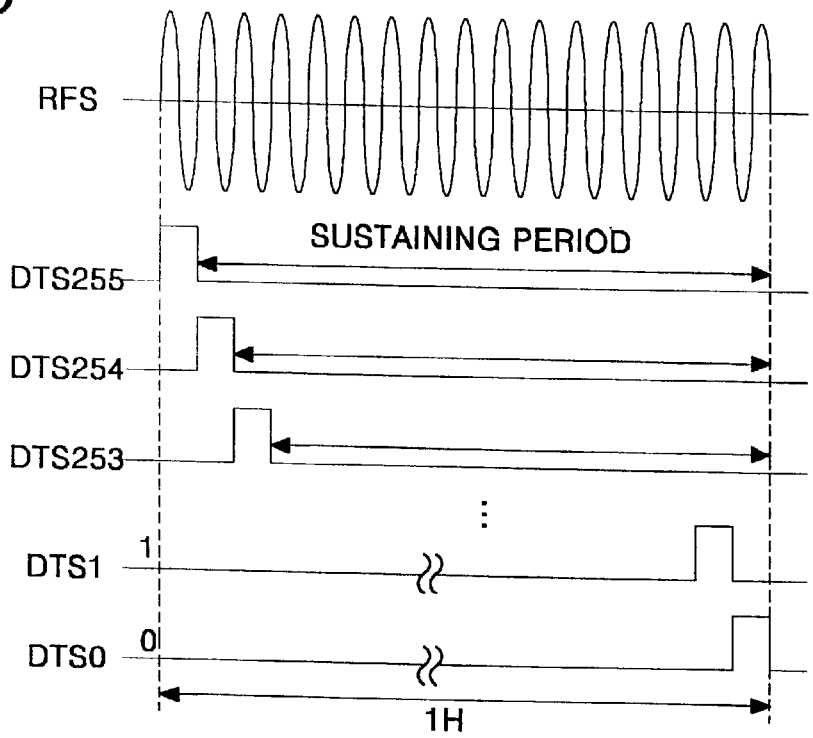
FIG. 9 is a waveform diagram of driving signals for explaining a PDP drive method according to another embodiment of present invention.
Figure 10:
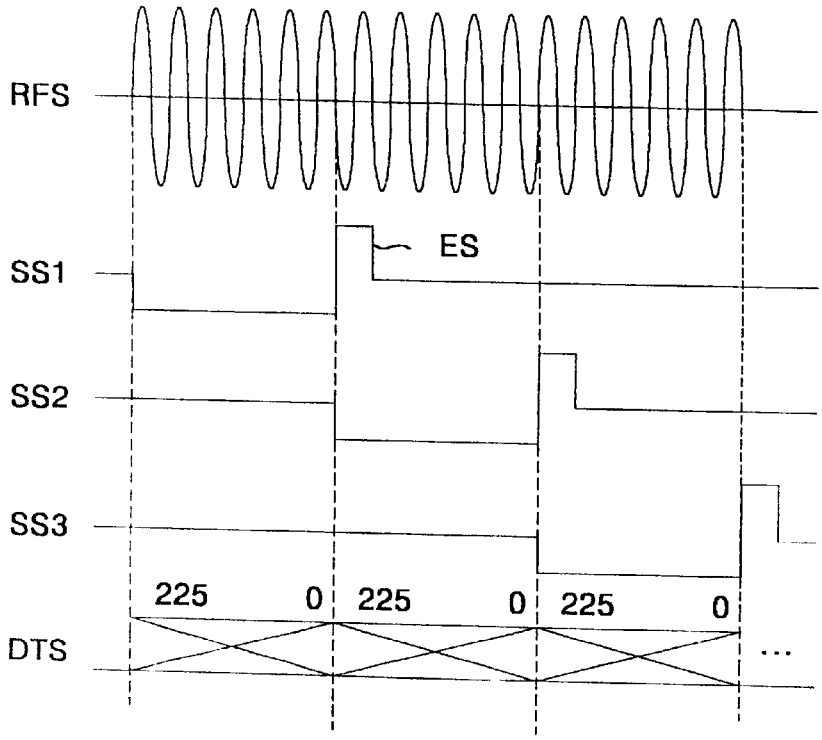
FIG. 10 is a waveform diagram of driving signals for explaining a PDP drive method according to still another embodiment of present invention.

FIGS. 9 and 10 explain a PDP drive method of RF system according to another embodiment of the present invention. Referring to FIG. 9, the PDP drive method according to an embodiment of the present invention provides with 256 data triggering signals DTS255 to DTS0 in order to display all of 256 gray scale levels on a row line during one horizontal synchronous period. If there is displayed the gray scale level of "255 " corresponding to a most brightness level, the data triggering signal DTS255 is selectively applied to the discharging cell on a sustaining electrode line Yi at the start point of horizontal synchronous period. Then, the discharging cell receiving the data triggering signal DTS255 to its address electrode line causes a discharge by a voltage difference between the data triggering signal DTS255 and the sustaining signal SSi. Further, electric charged particles created by the discharge responds to a radio frequency signal RFS and allow a RF discharge to be generated during the horizontal synchronous period, so that the gray scale level of 255 is displayed in the discharging cell. The discharging cell displaying the gray scale level of 254 receives the data triggering signal DTS254, which is shifted from the data triggering signal DTS255 by a unit term (i.e., one step), to discharge during the period shorter than one horizontal synchronous period. Therefore, the gray scale level of 254 is displayed in the discharging cell receiving the data triggering signal DTS254. Similarly, the gray scale levels of 253 to 0 are displayed in the discharging cells each receiving the data triggering signals DTS253 to DTS0 shifted by the unit term from each other, respectively. When the gray scale level of "0" is displayed, the data triggering signal DTS0 is applied to the address electrode line Xi at the end point of horizontal synchronous period. Consequently, the PDP drive method of RF system according to an embodiment of the present invention enables the data triggering signals DTS255 to DTS0 to be selectively applied to a discharging cell according to the brightness level, thereby implementing the gray scale. In this case, the RF signal RFS to be applied commonly to the RF electrode lines must have the power of below a threshold level which can not generate the RF discharge. Therefore, the discharging cell must have wall electric charges formed by any one of the data triggering signals DTS255 to DTS0 as well as the RF signal RFS in order to cause the RF discharge The RF discharge maintained continuously by the RF signal RFS can be stopped by a erasing pulse applied sequentially to the sustaining electrode lines Y1 to Yn every horizontal synchronous period. On the other hand, the RF discharge also can be stopped by the RF signal RFS. In this case, the RF signal RFS is sequentially applied to the RF electrode line by one horizontal synchronous period. For example, the RF signal is applied to the nth RF electrode line during period proceeding from the start point of horizontal synchronous period to the end point of horizontal synchronous period, thereby stopping the RF discharge.

Referring to FIG. 10, the PDP drive method of RF system according to another embodiment of present invention scans sequentially the row lines on the PDP by one horizontal synchronous period. Also, the PDP drive method of RF system according to another embodiment of present invention enables the discharging cells on the respective row lines to start on the discharge at the time when it is delayed more by the unit term from the start point of horizontal synchronous period in accordance with the brightness level. To this end, the PDP drive method of RF system provides a RF signal RFS, first to nth sustaining signals SS1 to SSn, and a data triggering signal DTS, as shown in FIG. 10. The RF signal RFS is applied to the RF electrode lines. The first to nth sustaining signals SS1 to SSn are supplied to the sustaining electrode lines Y1 to Yn, respectively. The data triggering signal DTS is applied to the first to mth address electrode lines X1 to Xm during one horizontal synchronous period. Such a data triggering signal DTS is enabled at the different time along with the brightness level, as the data triggering signals shown in FIG. 9. If the first sustaining signal SS1 is applied to the first sustaining electrode line Y1 and the data triggering signal DTS is supplied to the m address electrode lines Xl to Xm, the discharging cells on the first row line generate the RF discharge. After one horizontal synchronous period, each discharging cells on the first row line responds to a erasing pulse EP applied to the first sustaining electrode line Y1 to stop the RF discharge. As a result, each discharging cell on the first row line displays any one of 256 gray scale levels. Similarly, the second to nth sustain signals SS2 to SSn delayed by one horizontal synchronous period from the first sustaining signal SSl are respectively applied to the second to nth sustaining electrode lines Y2 to Yn and the data triggering signal DTS is repeatedly applied to the address electrode line X1 to Xm every horizontal synchronous period. Therefore, the discharging cells on the second to nth row lines cause once the RF discharge during the period corresponding to the brightness level. Consequently, the PDP drive method of RF system according another embodiment of the present invention scans the row lines on the PDP to realize the gray scale. To this end, the PDP drive method of RF system according to another embodiment of the present invention allows the gray scale levels to be displayed sequentially, thereby restraining the contour noise generated by the conventional PDP drive method. Also, the PDP drive method of RF system according to another embodiment of the present invention enables to discharge directly the discharging cells on each row line by the data triggering signal DTS such that an addressing period is eliminated. To this end, the RF discharging period is elongated and a discharging efficiency increases. As a result, the PDP drive method of RF system according to another embodiment of the present invention provides with the enhanced brightness.

Figure 11:
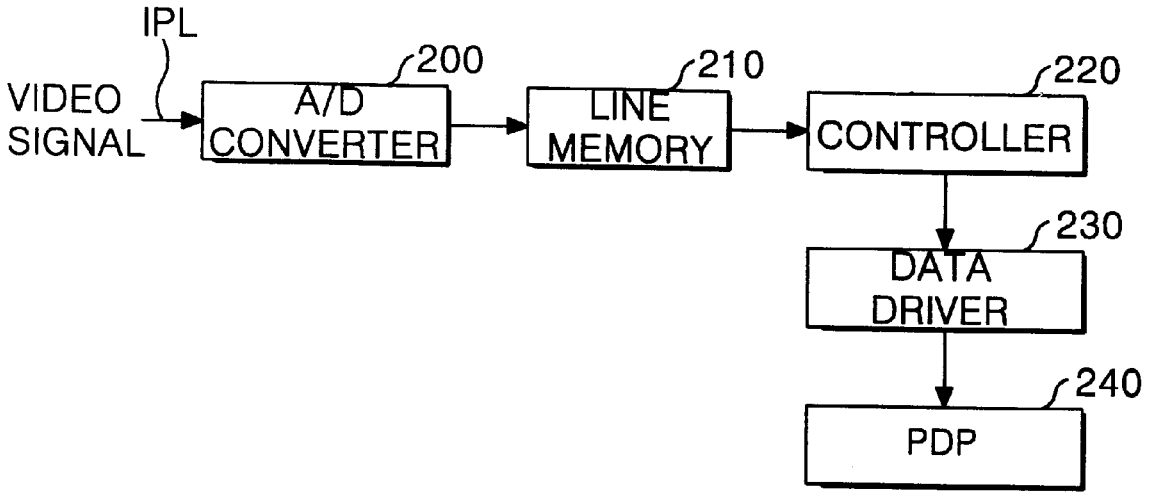
FIG. 11 is a schematic block diagram showing the configuration of a PDP drive apparatus according to an embodiment of present invention.

FIG. 11 illustrates a PDP drive apparatus of RF system according to an embodiment of the present invention including an A/D converter 200, a line memory 210, a controller 220 and a data driver 230 connected in series between an input line IL and a PDP. The A/D converter 200 converts an input analog video signal from the input line IL into a video data to be applied to the line memory 210. The line memory 210 stores temporally the video data from the A/D converter 200. Also, the line memory 210 has the capacity capable of storing the video data for one horizontal line. Further, the line memory 210 applies simultaneously the video data for one horizontal line to the controller 220. The controller 220 responds to the video data (i.e., pixel data) for one horizontal line from the line memory 210 and generates timing signals that are enabled at the time different from each other in accordance with the brightness level of video data. The number of timing signals corresponds to the number of discharging cells (i.e., pixels) arranged in one horizontal line. Also, the timing signals are sequentially applied to the data driver 230 in sequence of proceeding from a low level of video data to a high level of video data. The data driver 230 applies a reset pulse to the PDP 240 at the start point of the horizontal synchronous period. Also, the data driver 230 generates erasing pulses EP responding to the timing signal from the controller 220. The erasing pulses EP are delayed more by a unit term from the start point of horizontal synchronous period in accordance with the level of video data. The PDP 240 enables each discharging cell on a row line to discharge during the period of from the start point of horizontal synchronous period to the start point of erasing pulse EP. Therefore, a plurality of gray scale levels is sequentially displayed in the discharging cells on each row line.

As described above, the PDP drive apparatus of RF system according to an embodiment of the present invention allows the gray scale levels to be displayed sequentially, thereby restraining the generation of contour noise generated. Also, the PDP drive apparatus of RF system according to an embodiment of the present invention enables to discharge directly the discharging cells on each row line by the reset pulse such that an addressing period is eliminated. To this end, the discharging period is elongated and a discharging efficiency increases. As a result, the PDP drive apparatus of RF system according to an embodiment of the present invention provides with the enhanced brightness. Further, the PDP drive apparatus according to an embodiment of the present invention generates only the timing signals in accordance with the level of video signal, thereby simplifying its circuit configuration.

Figure 12:
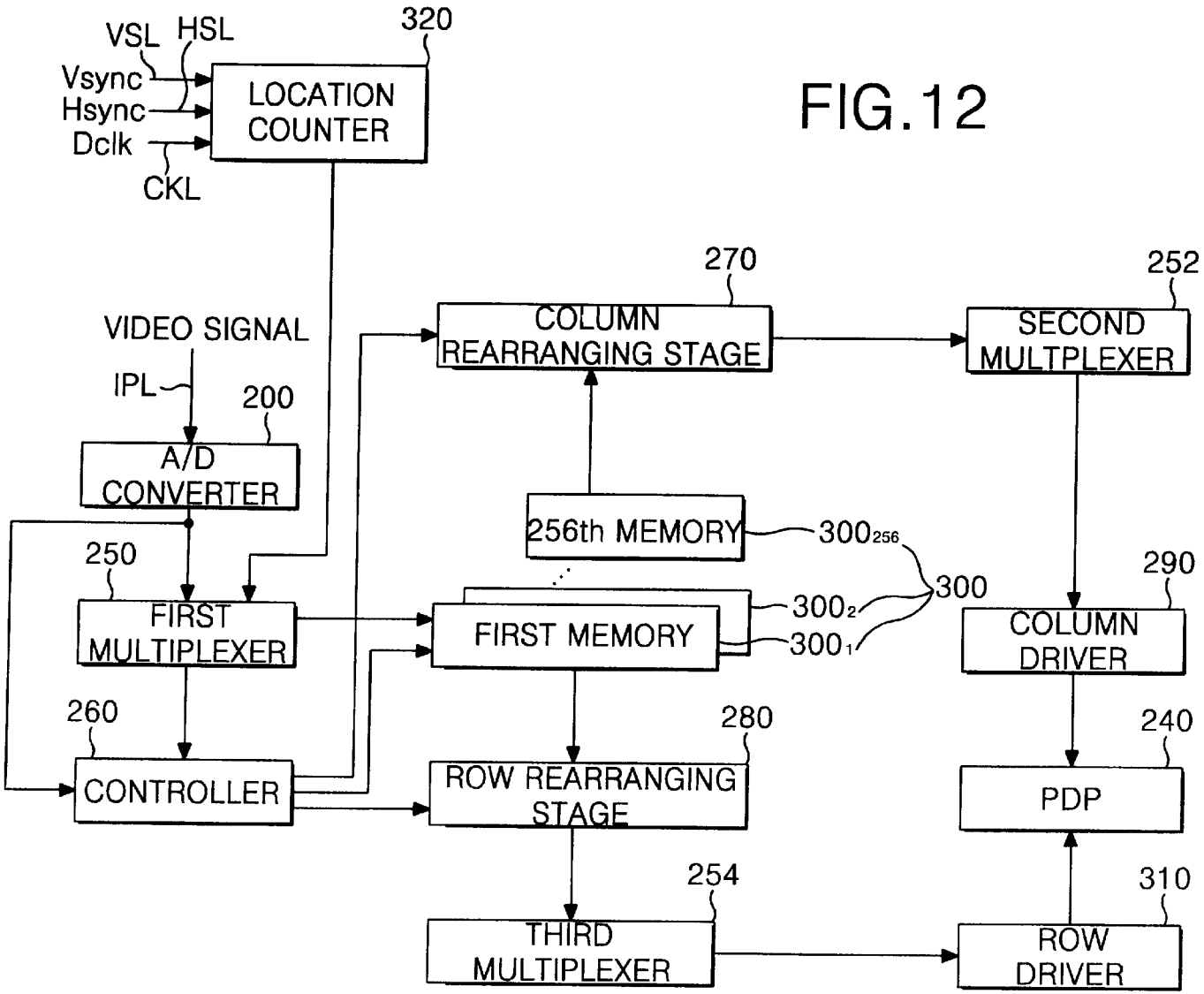
FIG. 12 is a schematic block diagram showing the configuration of a PDP drive apparatus of RF system according to another embodiment of the present invention.

FIG. 12 shows a PDP drive apparatus according to another embodiment of the present invention. The PDP drive apparatus includes an A/D converter 200 and a controller 260 connected in series an input line IPL, a location counter 320 and a first multiplexer 250 connected serially to a data clock line CKL, and 256 memories connected commonly to the first multiplexer 250. The A/D converter 200 converts an analog video signal from the input line IPL into a pixel data of 8 bits every period of data clock signal. The Pixel data is applied to the first multiplexer 250 and the controller 260. The location counter 320 receives a horizontal synchronous signal Hsync on a horizontal synchronous line HSL and a vertical synchronous signal Vsync on a vertical synchronous line VSL as well as the data clock signal Dclk on the data clock line CKL. The location counter 320 initialized a row location value of pixel every blanking interval of vertical synchronous signal Vsync. A column location value of pixel is reset by means of the location counter 320 every blanking interval of horizontal synchronous signal Hsync. Also, the location counter 320 increases the column location value of pixel by the data clock signal Dclk and counts up the row location value of pixel by the horizontal synchronous signal Hsync. Consequently, the location counter 320 generates a pixel location information including the column and row location values. Further, the location counter 320 can count pictures in number responding to the vertical synchronous signal Vsync. In this case, the pixel location information becomes to further comprise the picture number. The first multiplexer 250 responds to the pixel data from the A/D converter 200 and applies the pixel location information to any one among the 256 memories $\mathbf{300}_1$ to $\mathbf{300}_{256}$. In other words, the first multiplexer 250 applies selectively the pixel location information to the 256 memories $\mathbf{300}_1$ to $\mathbf{300}_{256}$ according to a value of pixel data (i.e., a gray scale) to classify the pixel location information by frames, colors and rows. If the pixel data has the value of "1", the first multiplexer 250 supplies the pixel location information to a first memory $\mathbf{300}_1$. Also, when the value of pixel data is "256", the first multiplexer 250 applies the pixel location information to the 256th memory $\mathbf{300}_{256}$. The controller 260 detects whether the analog video signal exists or not on the input line IPL on the basis of the pixel data. As a detecting resultant of analog video signal, the controller 260 controls an operation of first multiplexer 250 and a writing mode of memories $\mathbf{300}_1$ to $\mathbf{300}_{256}$. At the write mode, the controller 260 applies a write enable signal and an address signal to the memory $\mathbf{300}_1$ corresponding to the value of pixel data. Also, the controller 260 enables the 256 memories $\mathbf{300}_1$ to $\mathbf{300}_{256}$ to perform a reading out operation of pixel location information. The 256 memories $\mathbf{300}_1$ to $\mathbf{300}_{256}$ each stores the pixel location information from the first multiplexer 250 upon control of the controller 260. To this end, each of the 256 memories $\mathbf{300}_1$ to $\mathbf{300}_{256}$ stores only the pixel location information in association with each pixel which displays any one of the values of video data (any one of 256 gray scale levels). The pixel location information stored in each memory $\mathbf{300}_1$ to $\mathbf{300}_{256}$ is grouped into frames, colors and rows. The memories $\mathbf{300}_1$ to $\mathbf{300}_{256}$ only store the location information to reduce the storage capacity. The memories $\mathbf{300}_1$ to $\mathbf{300}_{256}$ are required by numbers corresponding to a number of the values of video data (i.e., a number of gray scale levels).

Figure 13:
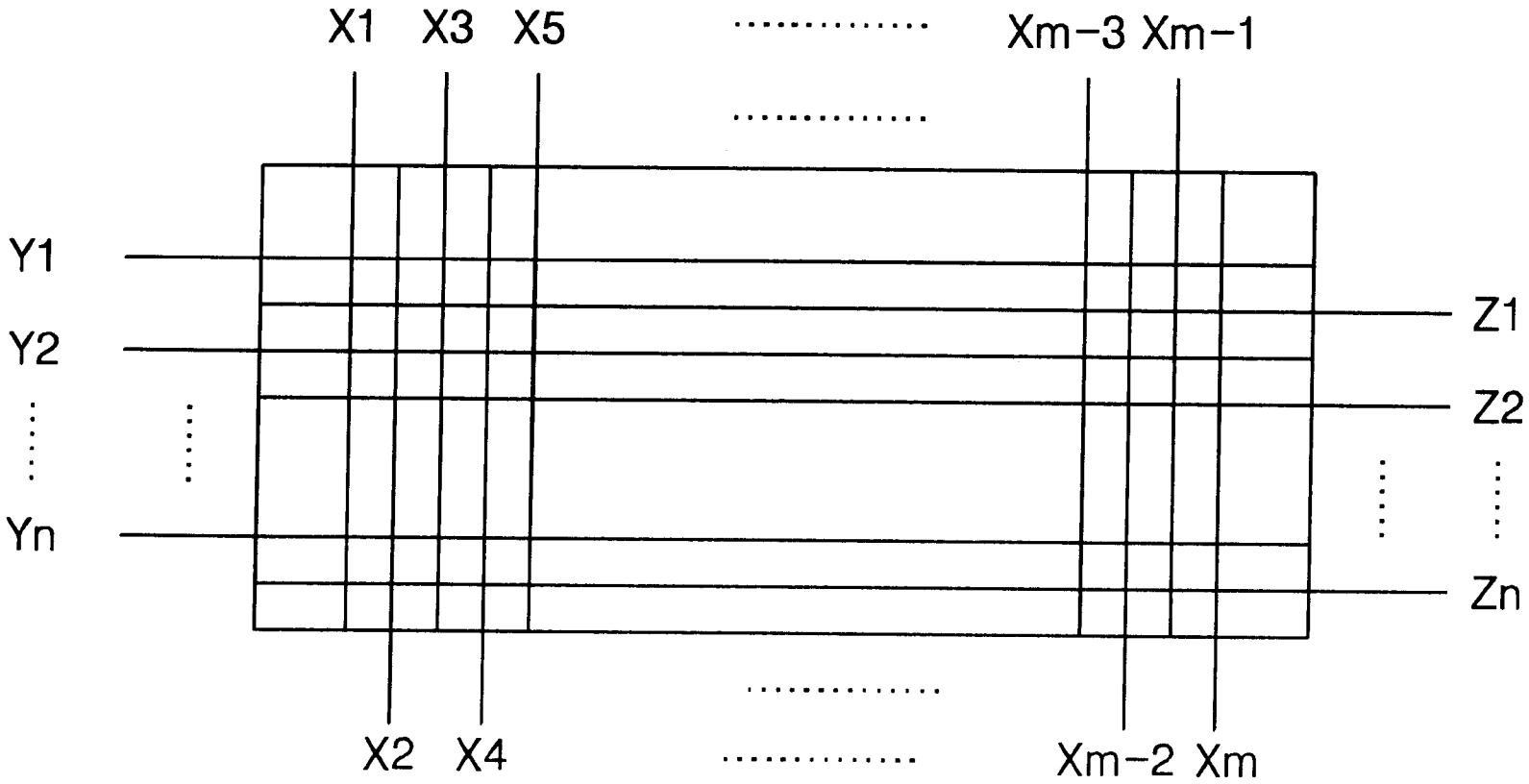
FIG. 13 is a schematic diagram showing an electrode configuration formed on the PDP in FIG. 12.

The PDP drive apparatus according another embodiment of the present invention has column and row rearranging stages 270 and 280 connected to all of the 256 memories $\mathbf{300}_1$ to $\mathbf{300}_{256}$. Also, the PDP drive apparatus further includes a second multiplexer 252 and a column driver 290 connected in series between the column rearranging stage 270 and a PDP 240, and a third multiplexer 254 and a row driver 310 connected serially between the row rearranging stage 280 and the PDP 240. The PDP 240 includes n Y and Z sustaining electrode line pairs Y1 to Yn and Z1 to Zn arranged in vertical direction and m address electrode lines X1 to Xm arranged in horizontal direction, as shown in FIG. 13. Each Y and Z sustaining electrode forms a row line and each address electrode line X1 to Xm is used for a column line. The PDP further comprises nxm discharging cells arranged at intersections of the Y and Z sustaining electrode line pairs Y1 to Yn and Z1 to Zn and the address electrode lines X1 to Xm. The column rearranging stage 270 reads out the column location values of pixels from the 256 memories $\mathbf{300}_1$ to $\mathbf{300}_{256}$ every period of horizontal synchronous signal upon the control of the controller 260 and rearranges the column location values in the sequence of gray scale level (i.e., the value of video data). Also, the column rearranging stage 270 outputs the rearranged column location values to the column driver 290 through the second multiplexer 252. Then, the rearranged column location values proceed in a different sequence according to addressing systems of PDP 240. If the PDP 240 is addressed in a selectively erasing system such as the PDP drive method according to an embodiment of the present invention, the rearranged column location values are applied to the second multiplexer 252 along with the sequence of from "0" to "256" in the gray scale level. In the case of addressing the PDP 240 in a selectively writing system such as the PDP drive method according to another embodiment of the present invention, the rearranged column location values are output to the second multiplexer 252 along with the sequence of from "256" to "0" in the gray scale level. The column driver 290 responds to the rearranged column location values front the column rearranging stage 270 via the second multiplexer 252 and drives the m address electrode lines X1 to Xm on the PDP 240 in the selectively erasing or writing system. Also, the column driver 290 consists of at least two address driver integrated circuit (IC) chips. Therefore, the second multiplexer 252 separates the rearranged column location values for one row into the number of address driver IC chip. For example, if the column driver 290 includes a first address driver IC chip connected to odd address electrode lines X1, X3, . . . , Xn−1 and a second address driver IC chip connected to even address electrode lines X2, X4, . . . , Xm, the second multiplexer 252 divides the rearranged column location values into odd and even values. The row rearranging stage 280 reads out the row location values of pixel rows from the 256 memories $\mathbf{300}_1$ to $\mathbf{300}_{256}$ every period of vertical synchronous signal upon the control of the controller 260 and rearranges the row location values in the order of their value. Also, the row rearranging stage 280 outputs the rearranged row location values to the row driver 310 through the third multiplexer 254. The row rearranging stage 280 can be replaced with a row counter (not shown) generating a sequential row address signal. The row counter responds to a row pulse from the controller or to the horizontal synchronous signal Hsync to create the sequential row address signal. The sequential row address signal is applied to the row driver 310 through the third multiplexer 254, instead of the rearranged row location values. The row driver 310 responds to the rearranged row location values from the row rearranging stage 280 via the third multiplexer 254 and drives sequentially the Y and Z sustaining electrode pairs Y1 to Yn and Z1 to Zn. To this end, the row driver 310 consists of a Y sustaining driver (not shown) for applying a sustaining pulse to the Y sustaining electrode lines Y1 to Yn and a Z sustaining driver (not shown) for supplying the sustaining pulse to the Z sustaining electrode lines Z1 to Zn. If the PDP 240 is addressed in a selectively erasing system, the row driver 310 generates an Y sustaining electrode signal and a Z sustaining electrode signal. The Y sustaining electrode signal has a waveform being contrary to that of the Z sustaining electrode signal. The Y and Z sustaining electrode signal include sustaining pulses having the same period and 3-state voltage levels, respectively. The Y and Z sustaining electrode signals each have the sustaining pulses corresponding to the number of gray scale level. Also, the Y and Z sustaining electrode signals include a writing pulse inserted in a first sustaining pulse, respectively. The writing pulse is generated at the start time of horizontal synchronous period and allows all of the discharging cells to start on the sustaining discharge. The sustaining pulses maintain the sustaining discharge caused in each discharging cell on the row line. The Y sustaining electrode signal further comprises erasing pulses each added in the sustaining pulses. The erasing pulses are necessary by the numbers corresponding to the gray scale levels of video data, every period of horizontal synchronous signal. The erasing pulses included in the sustaining pulses are delayed more by a unit term (or a unit interval) from the start time point of horizontal synchronous period. On the other hand, the PDP 240 is addressed in a selectively writing system, the row driver 310 generates a Y sustaining electrode signal and a Z sustaining electrode signal. The Y sustaining electrode signal has a waveform being contrary to that of the Z sustaining electrode signal. The Y and Z sustaining electrode signal include sustaining pulses having the same period and 3-state voltage levels, respectively. The Y and Z sustaining electrode signals each have the sustaining pulses corresponding to the number of gray scale level, Also, the Y and Z sustaining electrode signals include a erasing pulse inserted in a middle voltage level of first sustaining pulse, respectively. The erasing pulse is generated at the start time of horizontal synchronous period and allows all of the discharging cells to initialize. The sustaining pulse maintains the sustaining discharge caused in each discharging cell on the row line. The Y sustaining electrode signal further comprises writing pulses each added in the high voltage level of sustaining pulse. The writing pulses are necessary by the numbers corresponding to the gray scale levels of video data, every period of horizontal synchronous signal. The writing pulses included in the sustaining pulses are delayed more by a unit term (or a unit interval) from the start time point of horizontal synchronous period.

Figure 14:
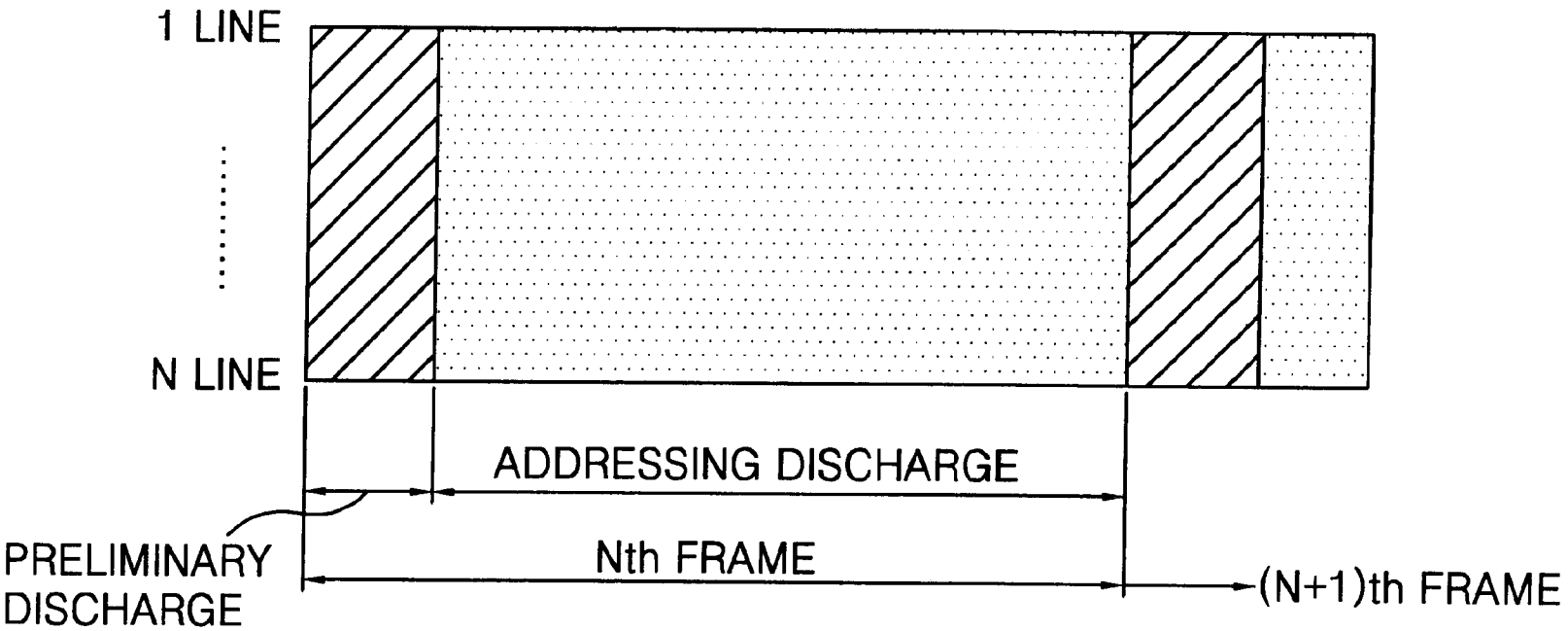
FIG. 14 is a schematic diagram explaining a PDP drive method according to still another embodiment of the present invention.
Figure 15:
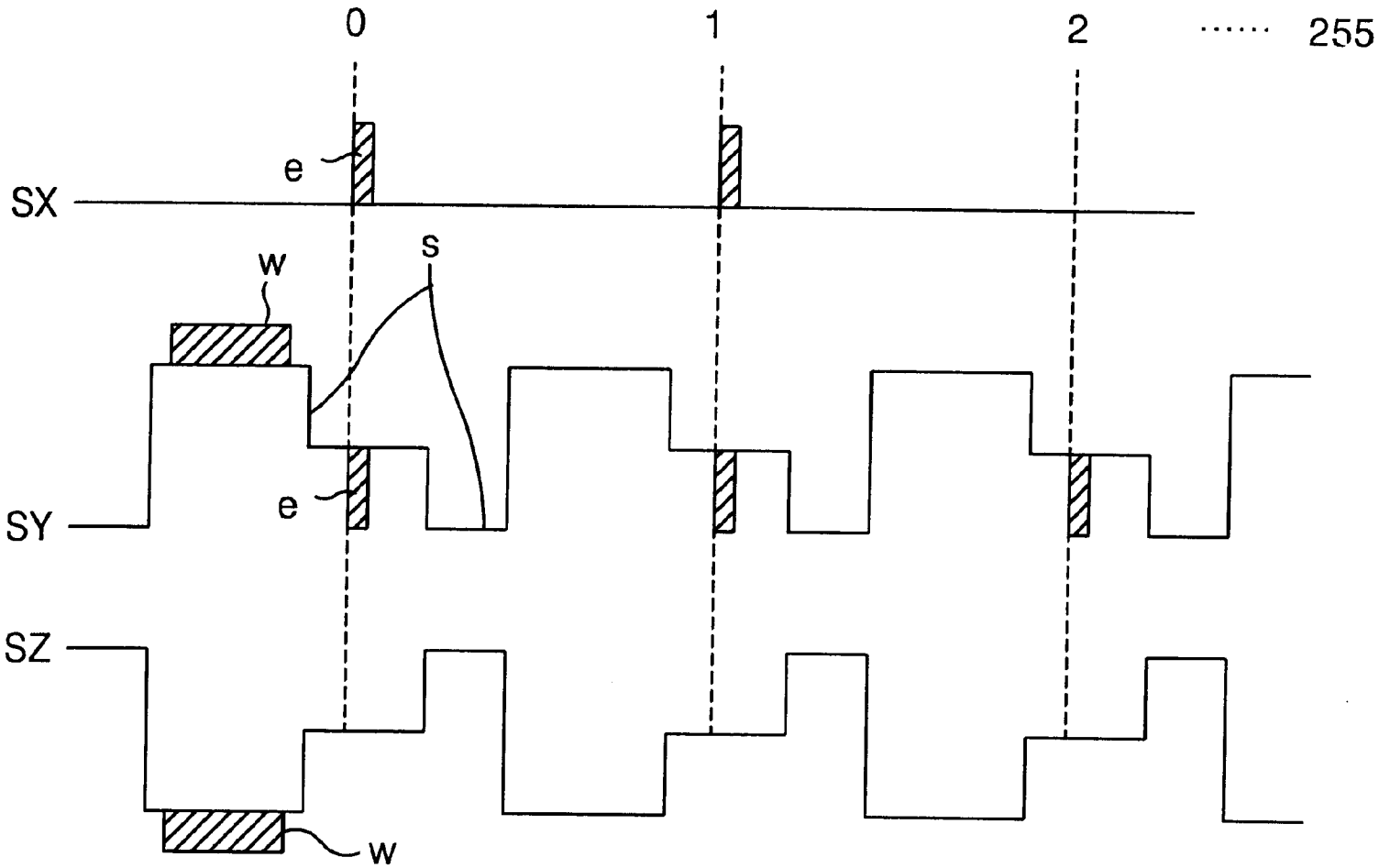
FIG. 15 is a schematic diagram explaining an addressing discharge of selectively erasing system included in the PDP drive method according to still another embodiment of the present invention.

Referring to FIGS. 14 and 15, there is illustrated a PDP drive method according to still another embodiment of the present invention. The PDP drive method according to still another embodiment of the present invention causes a preliminary discharge and an addressing discharge by once every period of frame, thereby realizing the gray scale. The preliminary discharge allows wall electric charges to be generated into all of discharging cells on a PDP. The preliminary discharge is a writing discharge turning on all of discharging cells. The addressing discharge proceeds sequentially from a first row line to an nth row line on the PDP. Also, the addressing discharge can be classified into a selectively erasing system and a selectively writing system. The addressing discharge of selectively erasing system allows all of the discharging cells on each row line to start on a sustaining discharge at the starting time of horizontal synchronous period. Next, the addressing discharge of selectively erasing system erases the sustaining discharge caused at each discharging cell after passed the time corresponding to the gray scale level of pixel data. To this end, the addressing discharge of selectively erasing system requires a writing pulse and erasing pulses added to a sustaining pulse. The writing pulse is generated at the start time of horizontal synchronous period and allows all of the discharging cells to start on the sustaining discharge. The numbers of sustaining pulse corresponds to the multiplication of the gray scale levels and the row lines. For example, If the PDP has n row lines and displays 256 gray scale levels, the PDP must input n×256 sustaining pulses. The sustaining pulse maintains the sustaining discharge caused in each discharging cell on the row line. The erasing pulses are necessary by the numbers corresponding to the gray scale levels of video data, every period of horizontal synchronous signal. The erasing pulses included in the sustaining pulses are delayed more by a unit term (or a unit interval) from the start time point of horizontal synchronous period. Also, the address electrode lines each receive one erasing pulse every period of horizontal synchronous signal. The sustaining discharge generated in each discharging cell on the row line is erased when the erasing pulse is applied to the address electrode line. The discharging cells displaying the same gray scale level allows the sustaining discharge to be cause simultaneously and the sustaining discharge to be erased simultaneously. For example, if the number of sustaining pulse is 256 (i.e., it are displayed the gray scale levels of 256 , the discharging cells displaying the gray scale level of "0" are erased at the first sustaining pulse. In other words, all of the discharging cells, in which the gray scale level does not display, erase the sustaining discharge at the first sustaining pulse. The sustaining discharge, which is generated in all of the discharging cells for displaying the gray scale level of "1", is erased at the second sustaining pulse. Similarly, all of the discharging cells, which display the gray scale level of "256 ", erase the sustaining discharge at the 256th sustaining pulse. As a result, the 256 gray scale levels are displayed in the discharging cells on a row line. In order to display the 256 gray scale levels, there are necessary 256 memories corresponding to the number of gray scale level.

Meanwhile, the addressing discharge of selectively writing system displays sequentially from the most gray scale level to the least gray scale level every period of horizontal synchronous signal. The addressing discharge of selectively writing system scans first to nth row lines after the preliminary discharge. Also, the addressing discharge of selectively writing system initializes the discharging cells on one row line of the PDP at the start time of horizontal synchronous period. Next, the addressing discharge of selectively writing system allows the discharging cells to start on the sustaining discharge in a time lag along with the gray scale level. As a result, a plurality of gray scale levels is displayed in the discharging cells on each row line.

FIG. 15 explains the addressing discharge of selectively erasing system included in the PDP drive method according to still another embodiment of the present invention. Referring to FIG. 15, there are shown an address electrode driving signal SX applied to the address electrode line X, a Y sustaining electrode signal SY applied to the Y sustaining electrode line Y, and a Z sustaining electrode signal SZ supplied to the Z sustaining electrode line Z. The Y sustaining electrode signal SY has a waveform being contrary to that of the Z sustaining electrode signal SZ. The Y and Z sustaining electrode signal SY and SZ include sustaining pulses s having the same period and 3-state voltage levels, respectively. The Y and Z sustaining electrode signals SY and SZ each have the sustaining pulses s corresponding to the number of gray scale level. Also, the Y and Z sustaining electrode signals SY and SZ include a writing pulse w inserted in a first sustaining pulse s, respectively. The writing pulse w is generated at the start time of horizontal synchronous period and allows all of the discharging cells to start on the sustaining discharge. The sustaining pulses s maintain the sustaining discharge caused in each discharging cell on the row line. The Y sustaining electrode signal SY further comprises erasing pulses e each added in the sustaining pulses s. The erasing pulses are necessary by the numbers corresponding to the gray scale levels of video data, every period of horizontal synchronous signal. The erasing pulses e included in the sustaining pulses s are delayed more by a unit term (or a unit interval) from the start time point of horizontal synchronous period. The address electrode driving signal SX has one erasing pulse s in synchronization with any one among the erasing pulses $\epsilon$ included in each sustaining pulse, The erasing pulse $\epsilon$ of address electrode driving signal SX is delayed more by the period of sustaining pulse in accordance with the gray scale level. The erasing pulse $\epsilon$ of address electrode driving signal SX erases the sustaining discharge generated in each discharging. The discharging cells displaying the same gray scale level allows the sustaining discharge to be cause simultaneously and the sustaining discharge to be erased simultaneously. All of the discharging cells, in which the gray scale level does not display, erase the sustaining discharge at the first sustaining pulse. The sustaining discharge, which is to generated in all of the discharging cells for displaying the gray scale level of "1", is erased at the second sustaining pulse. Similarly, all of the discharging cells, which display the most gray scale level, erase the sustaining discharge at the last sustaining pulse. As a result, the plurality of gray scale levels is displayed in the discharging cells on a row line. In order to display the 256 gray scale levels, there are necessary 256 memories corresponding to the number of gray scale level.

Figure 16:
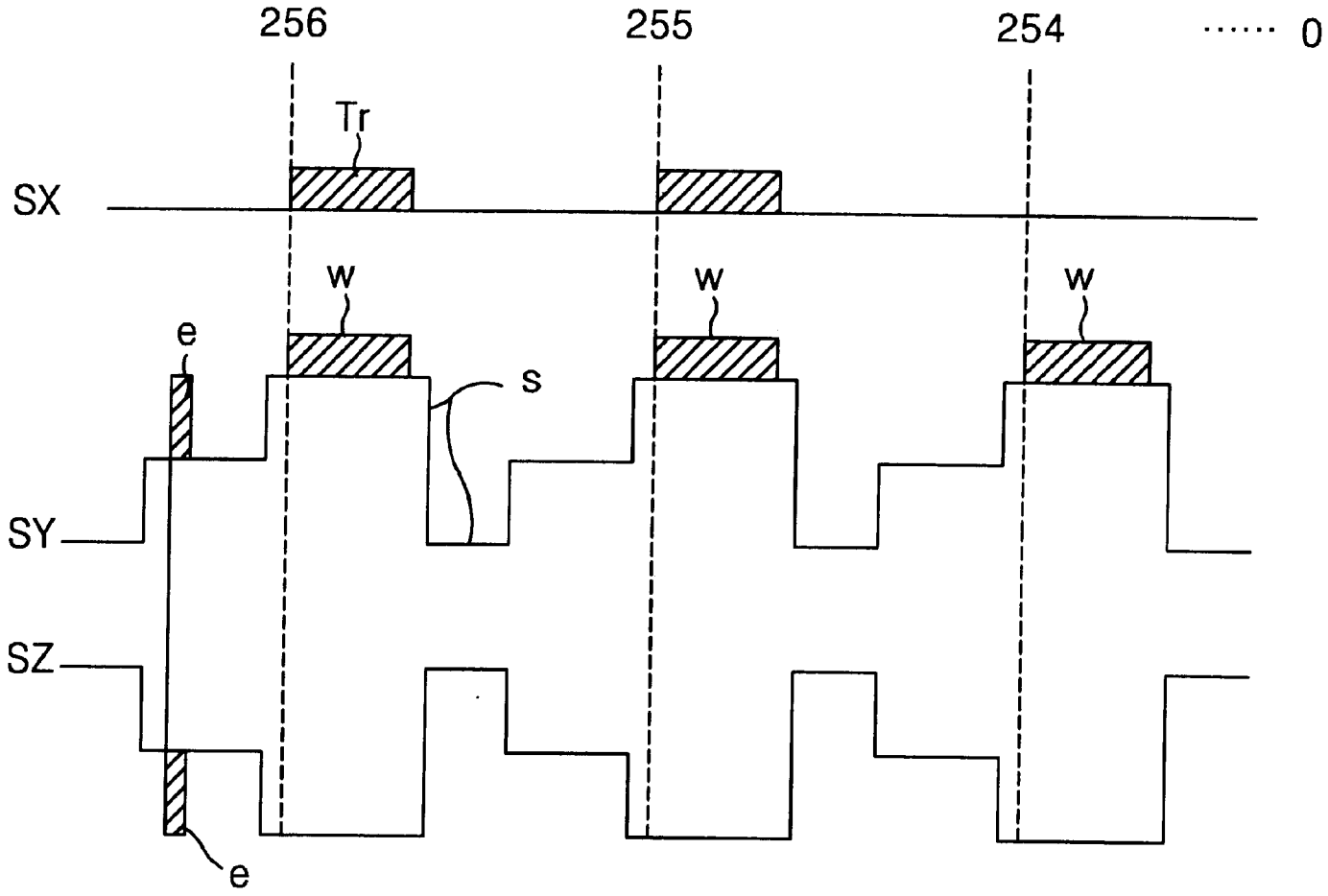
FIG. 16 is a schematic diagram explaining an addressing discharge of selectively writing system included in the PDP drive method according to still another embodiment of the present invention.

FIG. 16 explains the addressing discharge of selectively writing system included in the PDP drive method according to still another embodiment of the present invention. Referring to FIG. 16, there are shown an address electrode driving signal SX applied to the address electrode line X, a Y sustaining electrode signal SY applied to the Y sustaining electrode line Y, and a Z sustaining electrode signal SZ supplied to the Z sustaining electrode line Z. The Y sustaining electrode signal SY has a waveform being contrary to that of the Z sustaining electrode signal SZ. The Y and Z sustaining electrode signal SY and SZ include sustaining pulses s having the same period and 3-state voltage levels, respectively. The Y and Z sustaining electrode signals SY and SZ each have the sustaining pulses s corresponding to the number of gray scale level. Also, the Y and Z sustaining electrode signals SY and SZ include a erasing pulse $\epsilon$ inserted in a middle voltage level of first sustaining pulse s, respectively. The erasing pulse $\epsilon$ is generated at the start time of horizontal synchronous period and allows all of the discharging cells to initialize. The sustaining pulse s maintains the sustaining discharge caused in each discharging cell on the row line. The Y sustaining electrode signal SY further comprises writing pulses w each added in the high voltage level of sustaining pulse s. The writing pulses w are necessary by the numbers corresponding to the gray scale levels of video data, every period of horizontal synchronous signal. The writing pulses w included in the sustaining pulses s are delayed more by a unit term (or a unit interval) from the start time point of horizontal synchronous period. The address electrode driving signal SX has one triggering pulse Tr in synchronization with any one among the writing pulses w included in each sustaining pulse s. The triggering pulse Tr of address electrode driving signal SX is delayed more by the period of sustaining pulse in accordance with the gray scale level. The triggering pulse Tr of address electrode driving signal SX enables the discharging cell to start on the discharge. The discharging cells displaying the same gray scale level allows the sustaining discharge to be caused simultaneously and to be erased simultaneously. All of the discharging cells, in which the gray scale level of 256 is displayed, start the sustaining discharge at the first sustaining pulse. All of the discharging cells for displaying the gray scale level of "255", start the sustaining discharge at the second sustaining pulse.

Similarly, all of the discharging cells, in which the gray scale level of "0" is displayed, start the sustaining discharge at the last sustaining pulse. Consequently, the start time of sustaining discharge is gradually delayed by period of sustaining pulse according to lowering of gray scale level, thereby being gradually short the period of sustaining discharge. As a result, the plurality of gray scale levels is displayed in the discharging cells on a row line.

As described above, the PDP drive method and apparatus according to the present invention allows a picture having the gray scale on the PDP. Also, the PDP drive method and apparatus according to the present invention performs only once the preliminary discharge and the addressing discharge every frame period to realize the gray scale. Therefore, the PDP drive method and apparatus according to the present invention reduces an unnecessarily preliminary discharge at about ⅛ and enhances a contrast at least eight times. Also, the PDP drive method and apparatus according to the present invention reduces a consumption power. The PDP drive method and apparatus according to the present invention depends on the location values of pixels to display the picture having the gray scale. Thus, in the case of displaying the picture in high definition of HDTV having 1920×1080 pixels, the PDP drive method and apparatus according to the present invention can be short the length of shift register included in the driver, and further includes multiplexers to enhance the quality of picture without a high speed driving. Further, the PDP drive method and apparatus according to the present invention realizes the gray scale by emitting lights at once same as a cathode ray tube, thereby restraining a contour noise.

Although the present invention has been explained by the embodiments shown in the drawing hereinbefore, it should be understood to the ordinary skilled person in the art that the invention is not limited to the embodiments, but rather than that various changes or modifications thereof are possible without departing from the spirit of the invention. Accordingly, the scope of the invention shall be determined only by the appended claims and their equivalents.

What is claimed is:

1. A method for driving a plasma display panel using a radio-frequency discharge, comprising:

allowing discharging cells on the plasma display panel to start simultaneously on a radio frequency discharge by a row line;

sustaining the radio frequency discharge in the discharging cells for a single sustaining period corresponding to a brightness level of an image signal; and addressing each of the discharging cells on the row line once per image frame by applying an erasing pulse to each of the discharging cells on the row line, wherein each of the erasing pulses controls a corresponding single sustaining period in accordance with the brightness level of the image data so that the radio frequency discharge in each of the discharging cells is erased after the sustaining period corresponding to the brightness level of the image data.

2. The method as claimed in claim 1, wherein the radio frequency discharge starts by a radio frequency voltage applied to a radio frequency electrode on the plasma display panel and a reset signal applied simultaneously to data electrodes on each of the discharging cells on the row line.

3. The method as claimed in claim 2, wherein the reset signal synchronizes with a sustaining signal applied to a sustaining electrode on the row line and is equal to the sustaining signal in width.

4. A method for driving a plasma display panel using a radio frequency discharge, comprising:

addressing each of the discharging cells on a row line on the plasma display panel once per image frame by applying a triggering pulse to the address electrode of each of the discharging cells on the row line, wherein a RF signal is applied to RF electrode lines of each of the discharge cells, wherein the triggering pulse triggers a radio frequency discharge in each of the discharging cells on the row line, and wherein a timing of each triggering pulse defines a sustaining period corresponding to a brightness level of an image data; and sustaining the radio frequency discharge triggered in each of the discharging cells on the row line.

5. The method as claimed in claim 4, wherein the addressing and sustaining steps are implemented without using sub-frames of an image frame to generate gray scale.

6. The method as claimed in claim 4, wherein the timing of said each triggering pulse defines a single sustaining period corresponding to the brightness level of the image data.

7. The method as claimed in claim 4, wherein the radio frequency discharge in each of the discharging cells is erased by an erasing signal applied to the sustaining electrode lines at an end point of a horizontal period.

8. The method of claim 4, wherein the radio frequency discharge in each of the discharging cells is erased by removing the RF signal from the RF electrode lines in each of the discharging cells.

9. The method as claimed in claim 1, wherein a scanning to each of a plurality of scanning lines is performed only once without dividing an addressing interval and a sustaining interval for said each scanning line.

10. The method as claimed in claim 1, wherein the single sustaining periods corresponding to the brightness level are implemented without using sub-frames of the image frame to generate gray scale.

11. An apparatus for driving a plasma display panel using a radio frequency discharge, comprising:

converting means for converting an input video signal into a video data;

storage means for storing temporally the video data for a row line;

control means for rearranging the video data for a row line stored in the storage means in order of brightness level and for generating driving signals having a time lag according to the brightness level; and data driving means for applying data triggering signals corresponding to the driving signals to data electrodes on the plasma display panel.

12. The apparatus as claimed in claim 11 further comprising:

sustaining driving means for applying a sustaining signal to sustaining electrodes on the plasma display panel every horizontal period; and radio frequency driving means for applying a radio frequency signal to radio frequency electrodes on the plasma display panel.

13. The apparatus as claimed in claim 11, wherein the control means provides with the driving signal shifted according to proceeding from a low brightness level to a high brightness level.

14. The apparatus as claimed in claim 11, wherein the driving signals address each cell on the row line of the plasma display panel once during a horizontal synchronous period to generate one of a plurality of gradiation levels forming the brightness level.

15. The apparatus as claimed in claim 14, wherein the driving signals address said each cell on the row line by generating a trigger pulse that defines a single sustaining period based on the time lag.

16. A method for driving a plasma display panel, including a plurality of cells, each cell including a scanning electrode, a data electrode intersecting with the scanning electrode and a sustaining electrode in parallel with the scanning electrode, comprising:

causing simultaneously a preliminary discharge in entire cells;

allowing the entire cells to start simultaneously on a sustaining discharge; and performing a single addressing for each cell per image frame, wherein the single addressing is performed by applying an erasing pulse, which erases the sustaining discharge started on the entire scanning lines, to the entire scanning lines with a time difference corresponding to a brightness of desired image data so that the sustaining discharge is erased simultaneously at the scanning lines having a same brightness level.

17. The method as claimed in claim 16, wherein the preliminary discharge is a writing discharge turning on the entire picture element cells.

18. The method as claimed in claim 16, wherein the sustaining discharge is caused by applying a sustaining pulse to a sustaining electrode on the plasma display panel.

19. The method as claimed in claim 16, wherein the step erasing the sustaining discharge is performed simultaneously in the picture element cells displaying commonly a gray scale every period of sustaining pulse.

20. The method as claimed in claim 16, wherein the erasing the sustaining discharge proceeds from the picture element cell displaying a high gray scale to the picture element displaying a low gray scale.

21. A method for driving a plasma display panel including a plurality of cells, each cell including a scanning electrode, a data electrode intersecting with the scanning electrode and a sustaining electrode in parallel with the scanning electrode, comprising:

causing simultaneously a preliminary discharge in entire scanning lines;

allowing the entire cells to start simultaneously on a sustaining discharge; and performing a single addressing for each cell per one frame interval, wherein the single addressing is performed by applying a writing pulse, which allows a sustaining discharge to be started, to the entire scanning lines with a time difference corresponding to a brightness of data so that the sustaining discharge is started simultaneously at the scanning lines having a same brightness level.

22. A drive apparatus for a display, comprising:

converting means for converting an analog video input signal to a digital video signal;

control means coupled to receive the digital video signal and configured to control the storage and rearrangement of the digital video data;

first multiplexing means coupled to receive the digital video data from the converting means, a first control signal from the control means, and pixel location information from a location counting means, wherein the first multiplexing means is configured to sort the digital video data by gray scale, and wherein a vertical synchronous signal, horizontal synchronous signal and a data clock signal are inputs to the location counting means;

storage means coupled to receive a second control signal from the control means and sorted digital video data from the first multiplexing means, wherein the storage means is configured in first through two-hundred-fifty-sixth memory locations to store sorted digital video data;

column and row rearranging means, each coupled to receive sorted digital video data from the storage means and a second and third control signal, respectively, from the controller means, wherein the column and row rearranging means are configured to rearrange data for a column and a row of a display, respectively;

second and third multiplexing means, each coupled to receive data from the column and row rearranging means, respectively, wherein the second and third multiplexing means are configured to output data to column and row driver means, respectively; and display means, coupled to receive data from the column and row driver means, and configured to display digital video data, wherein the control means controls the column and row rearranging means and the storage means so that the data to the column and row driver means include driving signals that address each cell on a scanning line of the display once during a horizontal synchronous period to generate a single sustaining discharge interval corresponding to one of a plurality of gradiation levels forming the gray scale.

23. A method for driving a plasma display panel, comprising steps of:

causing a preliminary discharge in entire picture element cells; and writing selectively lag the picture element cells on any one of row lines in a time according to a gray scale to start a sustaining discharge, wherein the sustaining discharge is generated without using subfields of a frame.

24. The method as claimed in claim 23, wherein the writing of the picture element cell is simultaneously generated by a writing pulse applied to a sustaining electrode corresponding to a selected row location information and a column location information pulse supplied to a column line in synchronization with the writing pulse, every period of the sustaining pulse.

* * * * *